United States Patent [19]

Zibell

[11] Patent Number: 4,538,804

[45] Date of Patent: Sep. 3, 1985

[54] EXERCISING MACHINE AND METHOD

[76] Inventor: J. Scott Zibell, 40 Brittany Ct., Charlotte, N.C. 28226

[21] Appl. No.: 469,853

[22] Filed: Feb. 25, 1983

[51] Int. Cl.[3] ..... A63B 21/22; A63B 23/04

[52] U.S. Cl. ..... 272/73; 272/132

[58] Field of Search ..... 272/144, 93, 73, 134, 272/132

[56] References Cited

U.S. PATENT DOCUMENTS

| | | | |
|---|---|---|---|
| 2,209,034 | 7/1940 | Paul | 272/73 |
| 2,673,088 | 3/1954 | Wentz | 272/73 |
| 3,127,171 | 3/1964 | Noland | 272/73 X |
| 3,189,344 | 6/1965 | Swarts | 272/73 X |
| 3,918,710 | 11/1975 | Niebojewski | 272/134 |
| 4,300,761 | 11/1981 | Howard | 272/73 |
| 4,373,716 | 2/1983 | Pagani | 272/73 |

*Primary Examiner*—Richard J. Johnson

*Attorney, Agent, or Firm*—Jim Zegeer

[57] ABSTRACT

An exercising machine and method is disclosed wherein a rigid body supporting platform is supported at one end at a level such that the supporting surface is inclined at an angle to the horizontal. The support is constituted by a U-shaped tubular frame member and a standard portion which is secured to the U-shaped frame member. The rigid body supporting platform has a notch at one end thereof through which the standard passes and means are provided for rotatably mounting the U-shaped frame member on the underside of the supporting platform. A pair of crank and pedal means are rotatably mounted such that a downward weight on the underside of the platform by the weight of the user urges the standard towards the user and the legs of the U-shaped member away from the weight to thereby stabilize the platform. A flexible non-extensible strap has a handle at one end and is adjustably connected to the standard so that the tendency of the user to slide downwardly due to gravity and due to exertion of pedaling on the pedals is opposed by the user exerting a force on the standard in a direction urged by the weight and to urge the user's body up the incline surfaces. Thus, both the upper torso of the user is isometrically exercised at the same time that the lower torso and legs are being exercised by pedaling activity.

7 Claims, 12 Drawing Figures

FIG. 2 (EXEMPLARY DIMENSIONS)
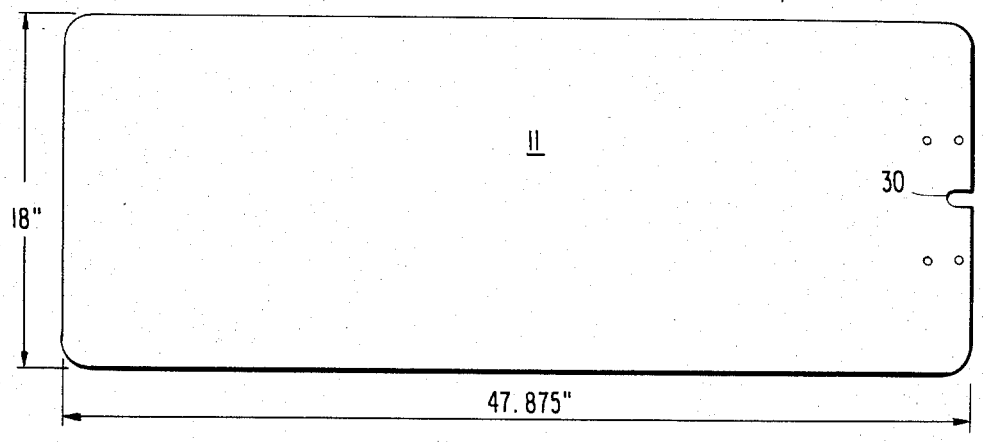
FIG. 3
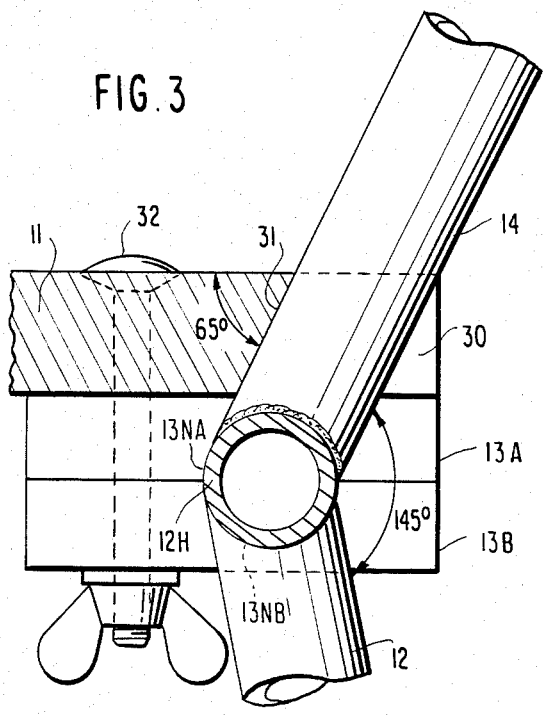
FIG. 10
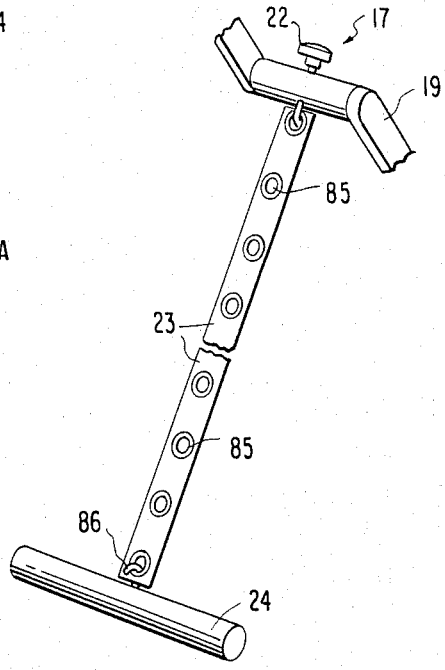

(EXEMPLARY DIMENSIONS)

(EXEMPLARY DIMENSIONS)

EXERCISING MACHINE AND METHOD

BACKGROUND OF THE INVENTION

This invention relates to an exercising apparatus and method and more especially to one in which the user is reclining with head below heart level and, at the same time, when the lower body portion is being exercised by pedaling activity, the upper body portion is being exercised isometrically, which, exercise at the same time tends to draw or pull the user's body up the inclined platform against the force of gravity and against reaction forces due to pedaling.

Pedal type exercises associated with reclining platforms are not new, being disclosed in such U.S. patents as Rogers Pat. No. 4,319,747, Werner design Pat. No. 210,083, Swarts Pat. No. 3,189,344, Levin et al Pat. No. 3,056,603, Shoor Pat. No. 2,784,591, Paul Pat. No. 2,209,034, Howard Pat. No. 4,300,761 and Dranselka Pat. No. 4,262,902. However, none of these prior devices provided exercise which exercise both upper and lower extremities in a simple, fold-away type, low cost, easily storable exercise machine.

According to the present invention, an inclined platform is provided in which the support legs for inclining the platform to the horizontal is secured to an adjustable standard or pedestal and rotatably mounted on the underside of the platform so that when the user places his or her weight on the platform, that weight tends to lock or stabilize the platform in the inclined position. Since gravity effects in the inclined position causes the user to tend to slide down the incline and acts conjointly with the pedaling activity which likewise tends to urge the user's body down the incline and away from the crank and pedal assembly, a flexible non-extensible strap is connected to one end of the standard approximate the hub of the crank and pedal assembly and a handle is coupled to the other end of the non-extensible strap to permit and enable the user to exert a force on the standard in a direction urged by the weight to urge the user's body against the force of gravity and the pedaling activity and up the inclined surface thereby further stabilizing the assembly and at the same time, isometrically exercising the user's upper and lower extremities while performing the pedaling exercises with the lower extremities. It will be appreciated that other exercises may be performed using the construction such as hand pedaling, sit-ups and the like.

BRIEF DESCRIPTION OF THE DRAWINGS

The above and other objects, advantages and features of the invention will become more apparent when considered with the following specification and accompanying drawings wherein:

FIG. 2 is a top elevational view of the body supporting platform shown in FIG. 1(*a*), FIG. 3 is a sectional view through the slot for the standard, FIG. 10 illustrates the handle and tension strap according to the invention.

DETAILED DESCRIPTION OF THE INVENTION

Figure 1:
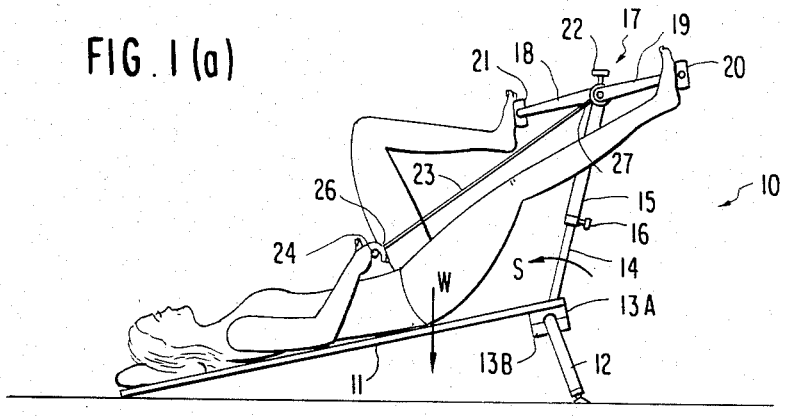
FIG. 1(*a*) is a side elevational view of an exercise machine incorporating the invention, FIGS. 1(*b*) and 1(*c*) show other ways of exercising or using the machine.
Figure 1:
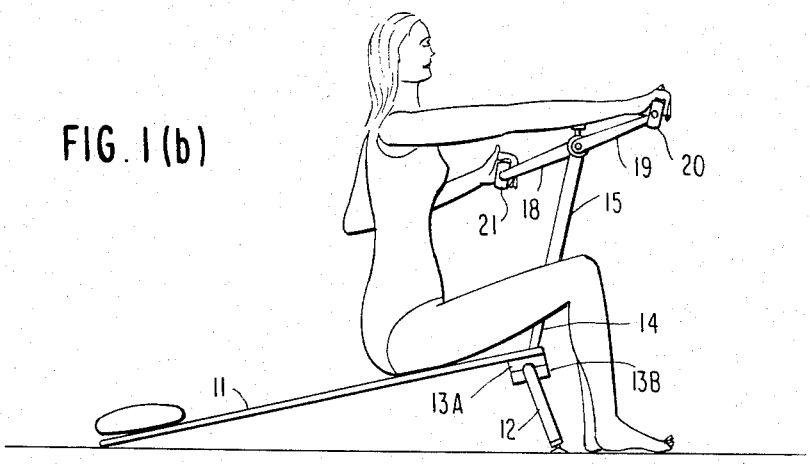
Figure 1:
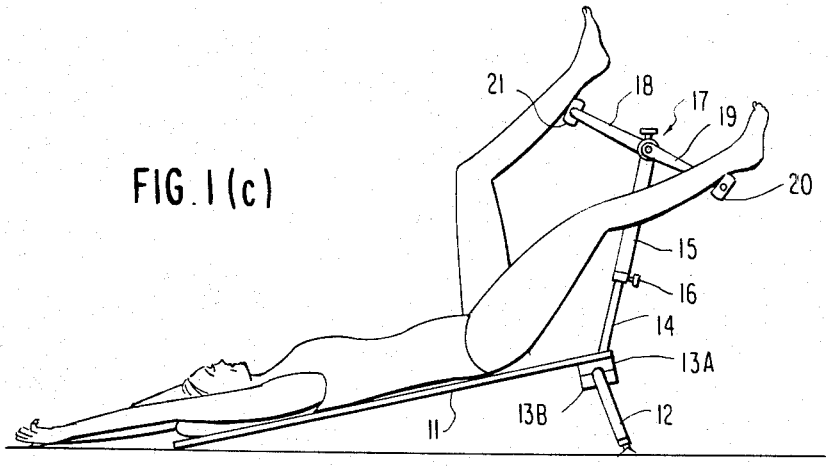
Figure 9:
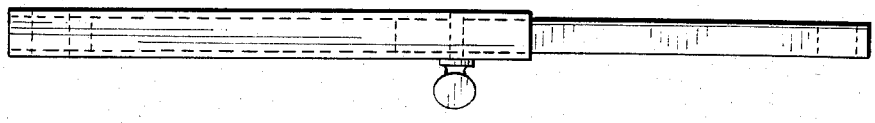
FIG. 9 is a side elevational view thereof.

The exercising machine 10 according to the invention comprises a rigid body supporting platform 11 which, in this embodiment is formed of ¾" plywood but can obviously be made of other materials such as a molded polymer, fiberglass or the like having sufficient strength and rigidity for the purposes disclosed herein. Body supporting platform 11 has means for supporting one end at a level such that a body supporting surface of supporting platform 11 is inclined at an angle to the horizontal, such angle in this embodiment preferrably being about 12½° whereby the user's head is below his heart. The supporting means comprises a U-shaped tubular frame member having a pair of legs 12 and a horizontal bar member 12H connecting the legs 12 and a standard or stem 14 welded to the center of the horizontal bar 12H. A pair of plywood block members 13A, 13B have notches 13NA and 13NB for receiving the horizontal tube of the U-shaped member and are secured by wing nuts in the notches on the underside of supporting platform 11 such that the downward weight of the user indicated by the arrow W on the upper side of the platform 11 urges the standard or stem 14 into notch 30 (see FIG. 3) toward the user and the legs of the U-shaped member away from the weight in the direction indicated by the curved arrow S. The stem or standard 14 has secured to it an adjustable hub-pedal supporting assembly 15 which is telescopingly carried on stem or standard 14 and is secured therein by locking screw 16. At the upper end of stem or standard 15 is carried or welded a hub assembly 17 having bearings supporting crank arms 18 and 19 to which on are pedals 20 and 21. A shaft (not shown in FIG. 1) in hub 17 has friction adjusted by an adjustment knob 22, as described more fully hereafter. The crank arms 18 and 19 are likewise adjustable to accommodate different size users leg lengths, etc.

As illustrated, when the user of the present exercise machine is pedaling, he is exerting a force in the direction aided by gravity tending to cause the user to slide down the incline and away from the pedal assembly. To counteract this, a flexible non-extensible strap 23 is provided having a handle 24 hooked or coupled to one end 26 and at the opposite end 27 to hub 17. Strap 23 has a series of grommeted holes 85 (FIG. 10) in it so that the length of the strap 23 may be adjusted to accommodate the user's body height and arm length. Thus, as the user is pedaling on the exercise machine 10, he is likewise pulling on handle 24 and via strap 23 exerting a further force on the standard tending to cause it to rotate in the direction of the curved arrow S. The user is also isometrically exercising or applying force to his arm muscles and upper torso body muscles at the same time that he is exercising the muscles in the lower portion of his body. The present invention relieves pressure on leg joints, abdominal organs and muscles as the body tone is regained. Moreover, the body is in the proper position so that the internal organs will tend to move back up into place and the leg muscles will be passively toned and free from strain and skeletal shock. The body is gently massaged inside and out toning the muscles and improving the circulation, digestion and well being. The cardiovascular system is likewise improved with the work load being removed from the leg veins helping to counteract conditions leading to varicose veins and phlebitis and is especially beneficial for those older citizens and new mothers.

In the condition shown in FIG. 1, where the user is lying, the legs, abdomen and lower torso receive the most effect with the upper torso receiving benefit through the use of tension strap 23 and handle 24.

The angling away of stem or standard 14, 15 from the plane or platform 11 permits the user to sit on the platform as illustrated in FIG. 1(*b*) to exercise his arms, neck and upper torso. At the same time, as shown in FIG. 1(*c*), the user may rest the calves of the leg in a different position while in the inclined position to also relieve pressure on leg joints and abdomenal organs and muscles.

Figure 5:
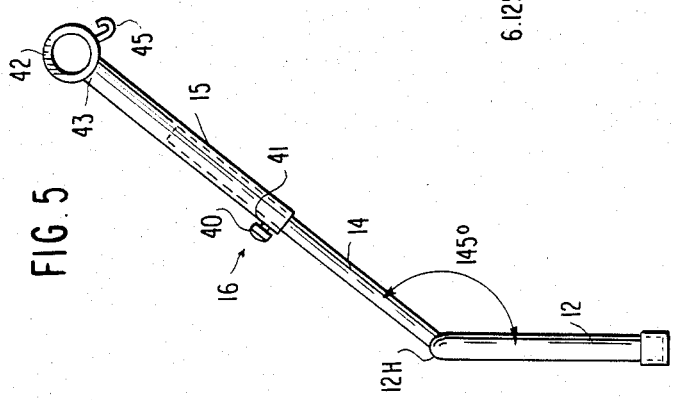
FIG. 5 is a side elevational view of FIG. 4.
Figure 4:
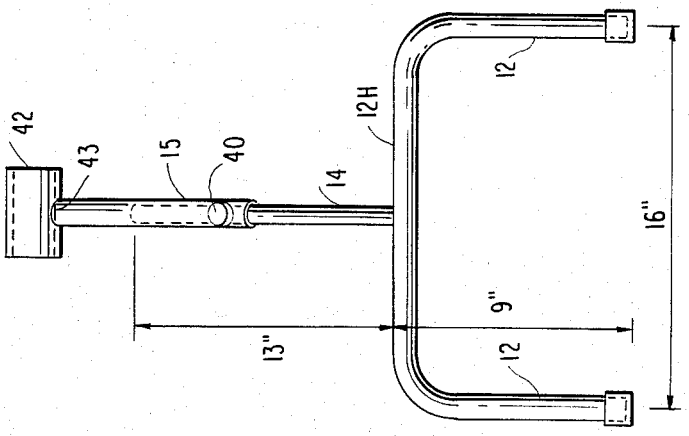
FIG. 4 is a plan view of the stem and leg assembly with the stem extension and hub thereon.

As shown in FIG. 2, the support platform 11 has a notch 30 formed at one end thereof and as shown in FIG. 3, the notch 30 has an inclined surface 31 against which bears the stem or standard 14. A pair of clamps 13A, 13B are secured by wing nut 32 to platform 11, permit the horizontal bar 12H to rotate relative to the platform 11. The stem or standard portion 14 is welded to the center of horizontal bar 12 and is at an angle of about 145° as indicated in FIG. 5. The lower ends of legs 12 may have rubber or plastic cups to prevent marring floor surfaces. The 65° angle for the surface 31 of notch 30 in relation to the 145° angle for between the stem portion 14 and legs 12 are such that the angle between the legs 12 and the underside of platform 11 is greater than 90° so that the force exerted by the downward weight W tends to lock the standard 14 in notch 30. Of course, when the user is drawing on handle 24 and strap 23, this adds to the locking effect thereby further enhancing the stability of the device during use. The U-shaped tubular frame 12, 12H has the stem 14 welded or otherwise secured thereto and is rotatable in its mounting so that the stem and pedal assembly may be rotated under platform 11 to thereby facilitate storage of the exercise machine. The stem or standard extension 15 telescopes over stem or standard 14 and is secured in an adjustable position by wing nut or knurled handle 40 in threadable engagement with the internal threads of weldment 41. The hub 42 is welded to the upper end 43 of stem or standard extension 15, a hook 45 is welded to the hub 42 and extends at an angle of about 60° to a vertical axis passing through stem or standard extension 15 and is provided for receiving and securing end 27 of tension strap 23. When stem extension 15 is telescoped over stem portion 14, the stem therefore is adjustable in length to accommodate different size users. The angle of the hook 45 to standard 15 can be adjusted in many ways and a hook may not be needed since the end of strap 27 may be secured to stem 15 and hub 42 in many ways. Strap 23 may simply be the end of a rope which is looped or hooked over or about the hub 42.

Figure 8:
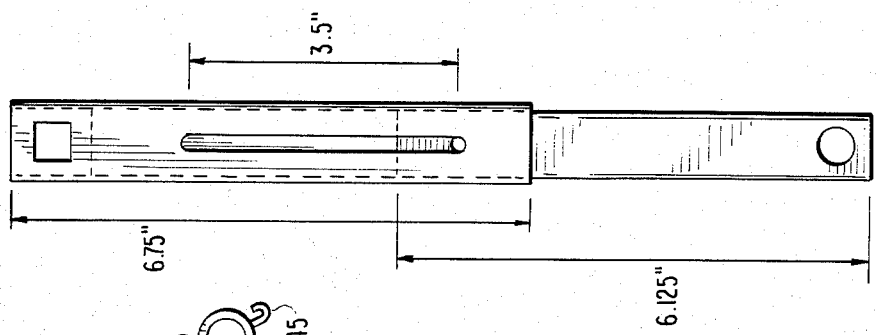
FIG. 8 is a plan view of the pedal arms showing the adjustment thereof.
Figure 7:
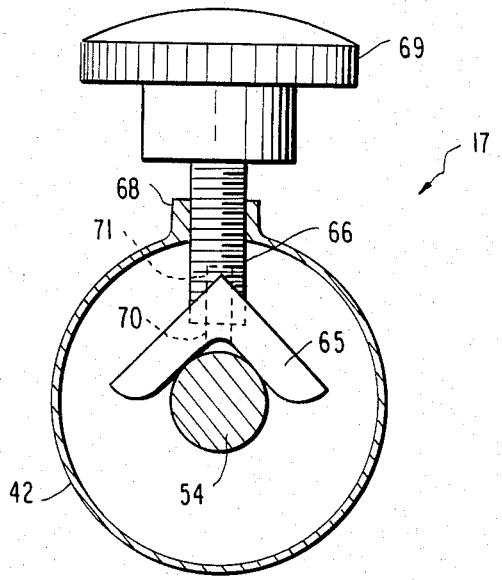
FIG. 7 is a section through the adjustment means for adjusting the resistance to pedaling.
Figure 6:
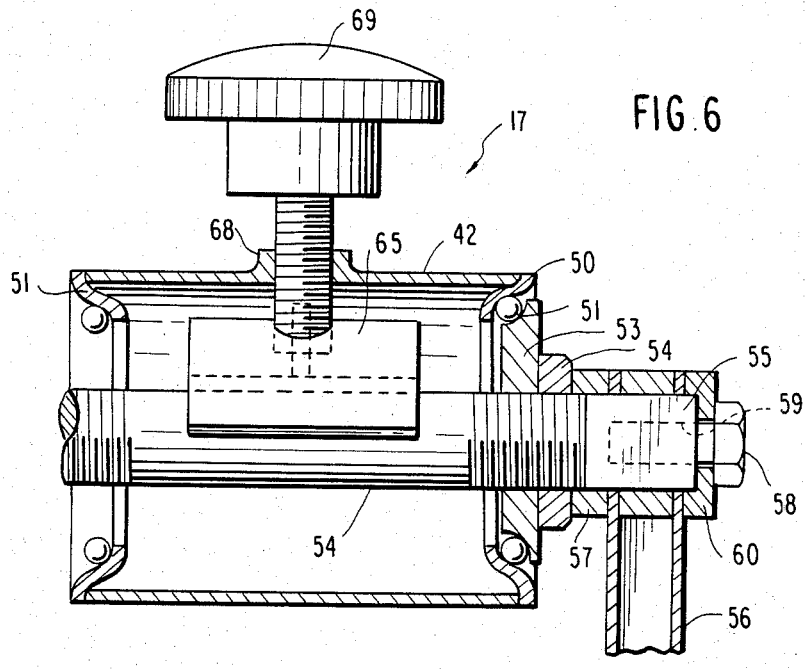
FIG. 6 is a cross section through the hub showing the crank and pedal connected thereto.

The details of the hub and crank assembly are shown in FIGS. 7 and 8. As shown in the sectional view of FIG. 7, a pair of bearing cups 50, 51 are received in the hub 42, the bearing cups having associated bearings 51 and bearing cone 53. A hub axle 54 is threadably engaged with the bearing cone 53 and a lock nut 54 prevents the bearing cone from loosening. It will be appreciated that other bearing-axle structures may be utilized. Axle shaft 54 has the outer end 55 square in cross section so as to pass through a square opening in pedal arm 56. A spacer 57 spaces the pedal arm 56 from lock nut 54. A cap screw 58 is threadably engaged with an internal bore 59 in the end of axle 54 and, via a washer 60 secures the pedal arm 56 to axle 54. While there is only shown the right assembly in FIG. 7, it will be appreciated that the same structure is repeated on the left side. Thus, the bearing cone 53, lock nut 54, spacer 57 and pedal arm 56 and cap screw and washer 58 and 60 all rotate.

In order to adjust the resistance of pedaling and thereby enhancing effect and adjust the amount of exertion by the user, friction on axle shaft 54 is adjusted. In accordance with this invention, this adjustment is by placing an angle restraint 65 bearing on the outer surfaces of shaft 54 via an adjustment screw 66. Adjustment screw 66 is threadably engaged with the internal threads of weldment 68 and the outer end of weldment 68 secured by an knurled or handle or knob 69. The angle restraint 65 is loosely retained at the end of threaded shaft 66 by a pin 70 which projects into an internal bore 71 at the end of threaded shaft 66. Thus, by tightening or loosening knob 69, angle restraint 65 is pressed tighter or less tight into engagement with the external surface of shaft 54 thereby adding or removing resistance to pedaling action of the user. The length of the pedals may be adjusted to accommodate different body sizes and lengths. In this respect, the arms 56 are formed in two parts with one part telescoping within the other and means for securing them in an adjusted position. Wing nut 80 passes through a slot in the outer telescoping member and is threadably engaged with the inner telescoping member to thereby form this adjustment. The tension strap 23 is of woven nylon but can be of other material, rope or the like. In the preferred embodiment, it is a flat nylon tension strap having a plurality of metal grommets 86 thereon for engagement with hook 45 on hub 42 and hook 86 on handle 24. Pillow 80 may be provided for the user's head.

The method according to the invention utilizes the lower torso, abdomen and legs for pedaling exercises and the upper body torso and arms for applying tension exercises to the arms while at the same time keeping the user's body from sliding down the incline during the pedaling exercise. Thus, the ultimate in exercising is provided to the user. As illustrated in FIGS. 1(*b*) and 1(*c*), the user can simply use the pedaling portions of the cranking with the hands and arms. As illustrated in FIG. 1(*c*), merely reposing on the exerciser with the body inclined provides beneficial results in that it relieves joints, abdomenal organs and muscles and the internal organs may be pushed into place.

While I have shown and illustrated a preferred embodiment of the invention, it will be appreciated that various modifications and improvements may be added thereto without departing from the spirit and scope of the invention as set forth in the claims appended hereto.

What is claimed is:

1. An exercise machine comprising, in combination, a rigid body supporting platform, means for supporting one end of said platform at a level such that it is inclined at an angle to the horizontal, said means supporting said one end of said platform including a U-shaped tubular frame member having a horizontal bar and a pair of legs, a standard mounted on one end of said rigid body supporting platform, means securing said standard to said U-shaped frame member at an angle other than 180 degrees, a pair of crank and pedal means, hub means for rotatably mounting said pair of crank and pedal means on the end of said standard, and means rotatably mounting said horizontal bar of said U-shaped frame on the underside of said rigid supporting platform such that a downward weight on the upper side of said platform urges said standard toward the weight and the legs of said U-shaped member away from said weight.

2. The invention defined in claim 1, including a flexible non-extensible strap means connected at one end to the upper end of said standard proximate said hub, and a handle secured to the other end of said non-extensible strap to enable the user to exert a force on said standard in the direction urged by said weight and to urge said user's body up the inclined surface of said rigid body supporting platform while exercising with said crank and pedal means.

3. The invention defined in claim 1, including notch means formed in the end of said body supporting platform through which said standard passes.

4. The invention defined in claim 1, wherein said standard includes means for lockably adjusting the length thereof.

5. The invention defined in claim 1, wherein said angle is about $12\frac{1}{2}°$.

6. A method of simultaneously exercising the upper and lower limbs and torso of the human body comprising, inclining said human body on an inclined platform so that the head of said human body is below the heart thereof, performing a pedaling exercise with the lower limbs and, simultaneously with said pedaling motion performing an isometric exercise between the arms and a point between the lower limbs and a point above said platform, said isometric exercise urging said human body up said inclined platform against the combined force of gravity and said pedaling exercise tending to slide said human body down said inclined platform.

7. The method defined in claim 6 including adjusting the degree of exertion required to perform said pedaling exercise and said isometric exercise.

* * * * *